US010337828B2

(12) United States Patent
Moretti

(10) Patent No.: US 10,337,828 B2
(45) Date of Patent: Jul. 2, 2019

(54) BALANCING DEVICE FOR FIREARMS

(71) Applicant: BENELLI ARMI S.P.A, Urbino (Pesaro Urbino) (IT)

(72) Inventor: Luigi Moretti, Collebeato (IT)

(73) Assignee: BENELLI ARMI, S.P.A., Pesaro Urbino (IT)

( * ) Notice: Subject to any disclaimer, the term of this patent is extended or adjusted under 35 U.S.C. 154(b) by 0 days.

(21) Appl. No.: 15/717,147

(22) Filed: Sep. 27, 2017

(65) Prior Publication Data

US 2018/0100719 A1 Apr. 12, 2018

(30) Foreign Application Priority Data

Oct. 6, 2016 (IT) ..... 102016000100452
Oct. 6, 2016 (IT) ..... UA2016A7124

(51) Int. Cl.

| | |
|---|---|
| ***F41C 27/22*** | (2006.01) |
| ***F41A 21/32*** | (2006.01) |
| ***F41C 23/22*** | (2006.01) |
| *F41C 7/00* | (2006.01) |
| *F41C 7/11* | (2006.01) |

(52) U.S. Cl.

CPC ..... *F41C 27/22* (2013.01); *F41A 21/32* (2013.01); *F41C 23/22* (2013.01); *F41C 7/00* (2013.01); *F41C 7/11* (2013.01)

(58) Field of Classification Search

CPC .... F41A 21/32; F41C 7/00; F41C 7/11; F41C 23/22; F41C 27/22
USPC ..... 42/90, 97
See application file for complete search history.

(56) References Cited

U.S. PATENT DOCUMENTS

| | | | | | |
|---|---|---|---|---|---|
| 2,302,699 | A | * | 11/1942 | Klipsch | F41C 27/22 42/76.01 |
| 2,731,753 | A | * | 1/1956 | Mathieu | F41C 23/06 42/1.06 |
| 3,340,641 | A | * | 9/1967 | Recker | F41C 27/22 42/75.01 |
| 3,618,245 | A | * | 11/1971 | Pruonto | F41C 27/22 42/71.01 |
| 3,619,925 | A | * | 11/1971 | Martin et al. | F41C 27/22 42/97 |
| 3,726,037 | A | * | 4/1973 | Wolff | F41A 21/24 42/112 |

(Continued)

FOREIGN PATENT DOCUMENTS

| | | |
|---|---|---|
| DE | 19825951 A1 | 12/1999 |
| DE | 102006022795 A1 | 12/2007 |

(Continued)

OTHER PUBLICATIONS

Krieghoff UK, "K-80 Balance System", 2017, https://www.krieghoff.co.uk/k80-balanve-system.html.

*Primary Examiner* — Stephen Johnson
*Assistant Examiner* — Benjamin S Gomberg
(74) *Attorney, Agent, or Firm* — R. Neil Sudol; Henry D. Coleman

(57) ABSTRACT

A balancing device for firearms having at least one barrel and one stock, a front support and a rear support respectively mounted in a region adjacent to the muzzle and in the region of the stock of the firearm; the front support and the rear support are configured to support one or more weight members which are modular and mutually analogous.

6 Claims, 4 Drawing Sheets

(56) References Cited

U.S. PATENT DOCUMENTS

| | | | | |
|---|---|---|---|---|
| 4,986,018 | A * | 1/1991 | McDonald, Jr. ..... | F41B 5/1426<br>124/89 |
| 7,055,276 | B2 * | 6/2006 | McPherson ..... | F41C 27/22<br>188/381 |
| 2007/0289191 | A1 * | 12/2007 | Cowan ..... | F41C 23/02<br>42/90 |
| 2010/0285720 | A1 * | 11/2010 | Smith ..... | A63H 33/30<br>446/473 |

FOREIGN PATENT DOCUMENTS

| | | | |
|---|---|---|---|
| IT | BS20090218 | A1 | 6/2011 |
| JP | S55175800 | U | 12/1980 |

* cited by examiner

BALANCING DEVICE FOR FIREARMS

BACKGROUND OF THE INVENTION

The present invention relates to a balancing device for firearms.

It has long been known to modify the balance of a firearm by applying weights in various positions on the body of the firearm.

Balancing systems of the known type are numerous and disparate. For example, balancing systems are known which are constituted by weights which can be applied to the barrel or barrels of a gun or to the rib.

The weights are normally fixed by means of screws in discrete positions or along guides that allow a continuous adjustment of the position of the weight or weights with respect to the extension of the barrel.

U.S. Pat. No. 3,726,037 discloses a system of the type described above.

Balancing devices are also known which provide for the application of one or more weights at the stock or grip of the firearm.

US 2010/0285720 discloses a marching band rifle which includes a recess in the stock for accommodating a series of weights, constituted by metallic discs, so as to adjust the balance of the rifle.

Italian patent application ITBS2009A218 discloses a balancing systems for hunting guns and target shooting guns which provides for one or more rear balancing masses which are inserted and retained transversely in the stock of the gun and one or more front balancing weights applied to the barrels. The stock of the gun is provided, in the region of the grip, with a cavity that is extended vertically and the rear balancing masses are accommodated and enclosed within the cavity.

DE19825951 discloses a lightweight frame for a gun made of carbon fiber laminate. The single piece frame includes the barrel support and the stock and has shaped recesses into which balance masses can be fitted to adjust the balance of the weapon. The ballast masses are secured by screw fasteners into threaded sleeves bonded into the laminate.

Balancing systems of the prior art have drawbacks of a functional nature, especially as regards the ease of application of the heavy masses.

In order to obtain the desired balance, the user must in fact mount and remove the weights several times before achieving the desired combination.

Since balancing systems of the known type have different weights and fastening systems for the barrels or for the stock, it is furthermore necessary to be equipped with several components having different shapes and weights.

The balancing system disclosed in DE19825951 cannot be adapted to different rifles and shotguns because it is not provided with a support for the masses. The weight of the masses cannot be finely adjusted and the masses cannot be mounted close to the muzzle.

Other prior art balancing systems do not allow for an independent balancing of the right or left hand side of the weapon.

OBJECTS OF THE INVENTION

The aim of the present invention is to provide a balancing device for firearms that overcomes the drawbacks of the cited prior art.

Within the scope of this aim, a particular object of the invention is to provide a balancing device that allows a quick mounting and removal of a series of weights.

Another object of the invention is to provide a device that allows to adjust the balance of the firearm accurately without resorting to an excessive number of components.

Another object is to provide a balancing device that is aesthetically appealing.

Another object of the present invention is to provide a device which, by virtue of its particular constructive characteristics, is capable of giving the greatest assurances of reliability and safety in use.

SUMMARY OF THE INVENTION

This aim and these and other objects that will become better apparent hereinafter are achieved by a balancing device for firearms comprising at least one barrel and one stock, at least one front support and at least one rear support respectively mounted in a region adjacent to said muzzle and in the region of said stock; said front support and said rear support being configured to support one or more weight members; said weight members being modular and mutually analogous.

BRIEF DESCRIPTION OF THE DRAWINGS

Further characteristics and advantages will become better apparent from the description of preferred but not exclusive embodiments of the invention, illustrated by way of non-limiting example in the accompanying drawings, wherein.

DETAILED DESCRIPTION

Figure 1:
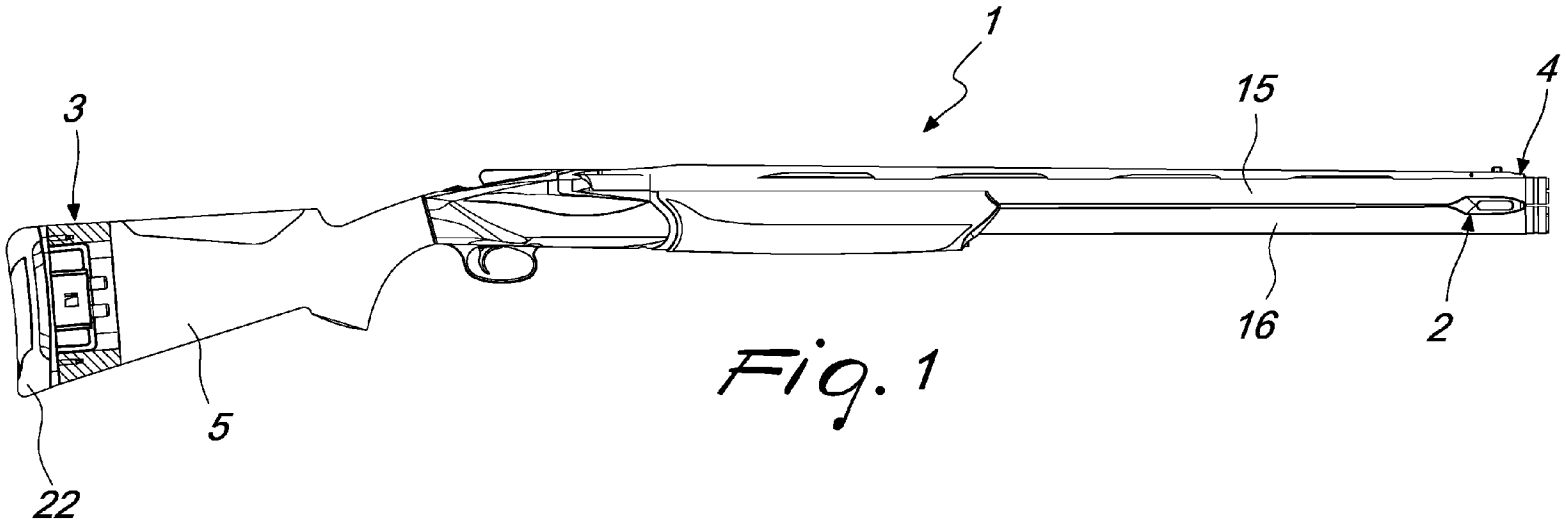
FIG. 1 is a side view of a gun, provided with the balancing device according to the present invention.
Figure 3:
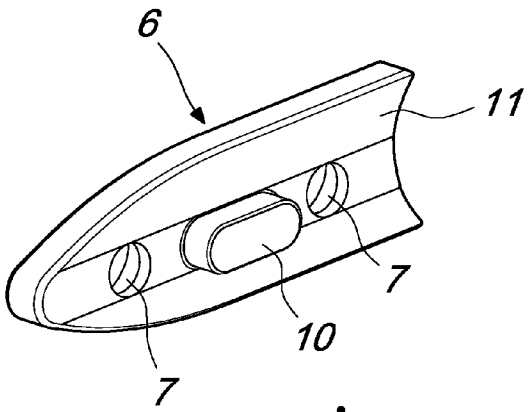
FIG. 3 is a perspective view of the rear side of a weight member.
Figure 2:
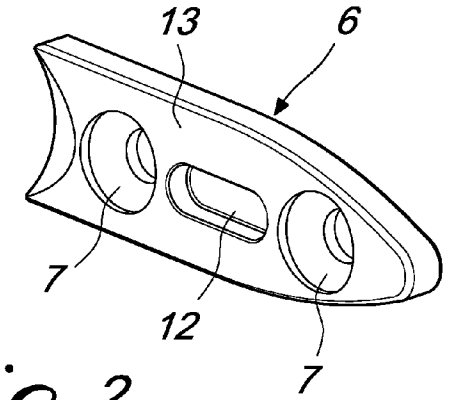
FIG. 2 is a perspective view of the front side of a weight member.
Figure 5:
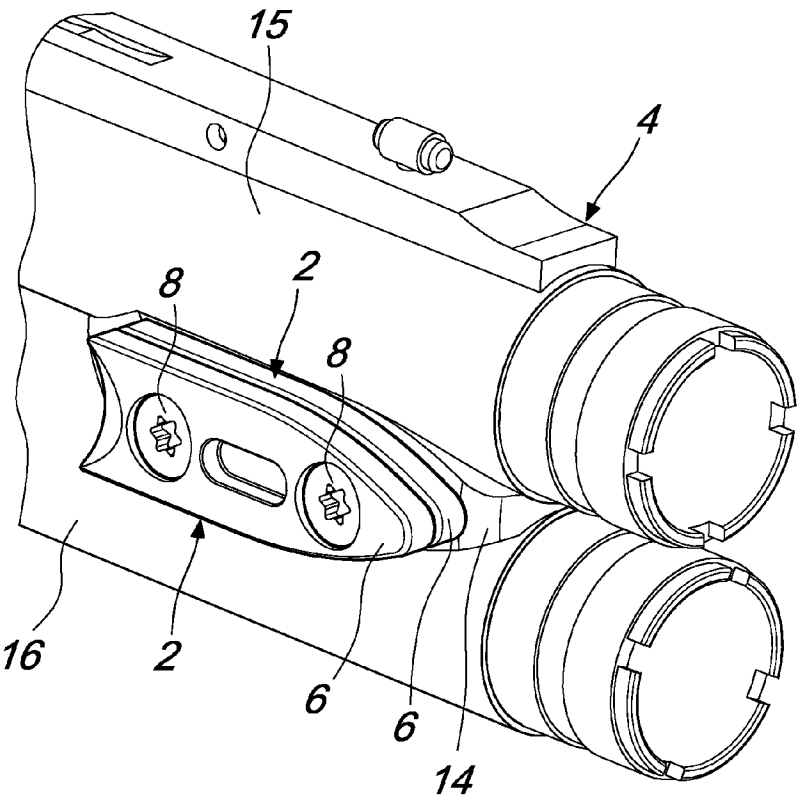
FIG. 5 is a view, similar to the preceding one, of the front support with two weight members applied.
Figure 4:
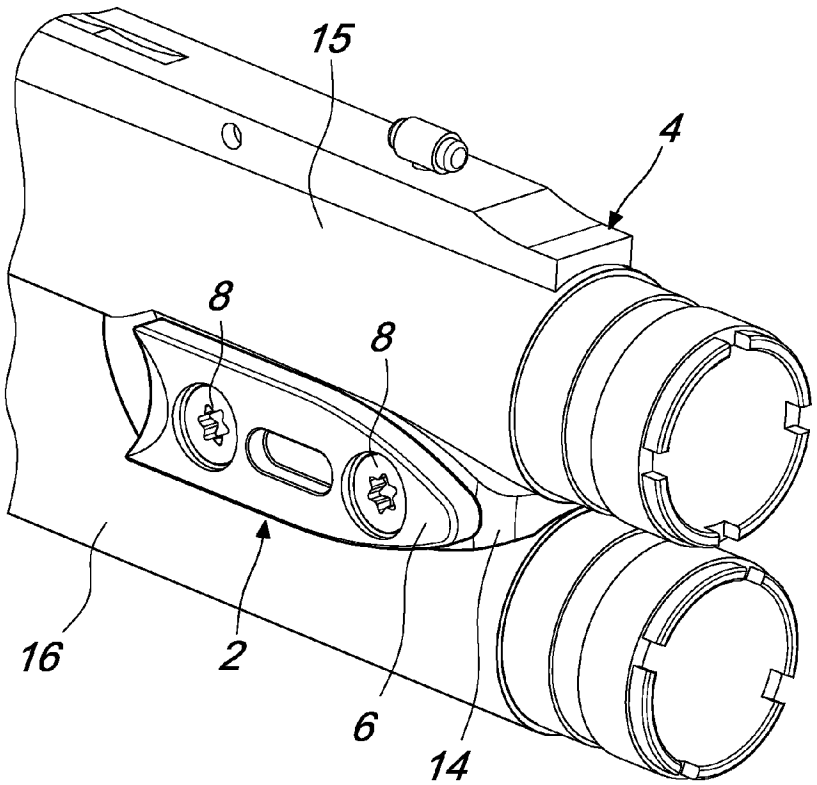
FIG. 4 is a perspective view of the muzzle region of the shotgun, showing the front support of the device with a weight member applied thereto.
Figure 7:
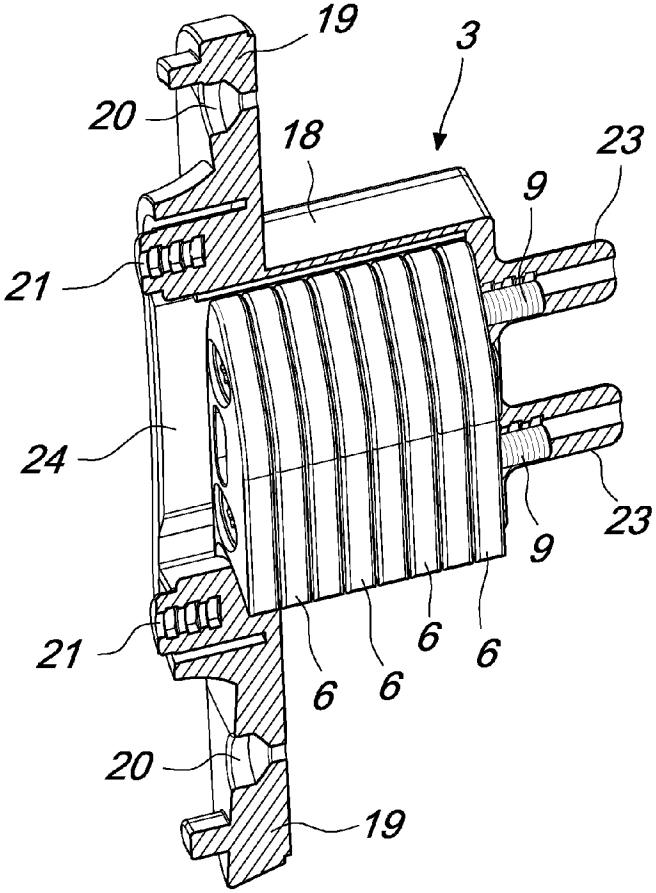
FIG. 7 is a longitudinally sectional perspective view of the rear support of the device with a plurality of weight members.
Figure 6:
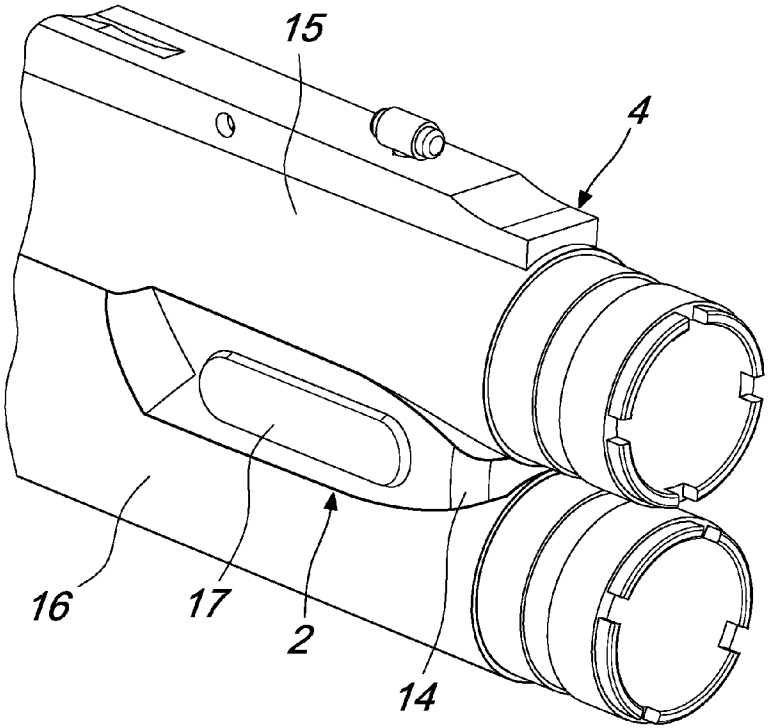
FIG. 6 is a view, similar to the preceding one, of the front support without any weight member and provided with a cover.
Figure 9:
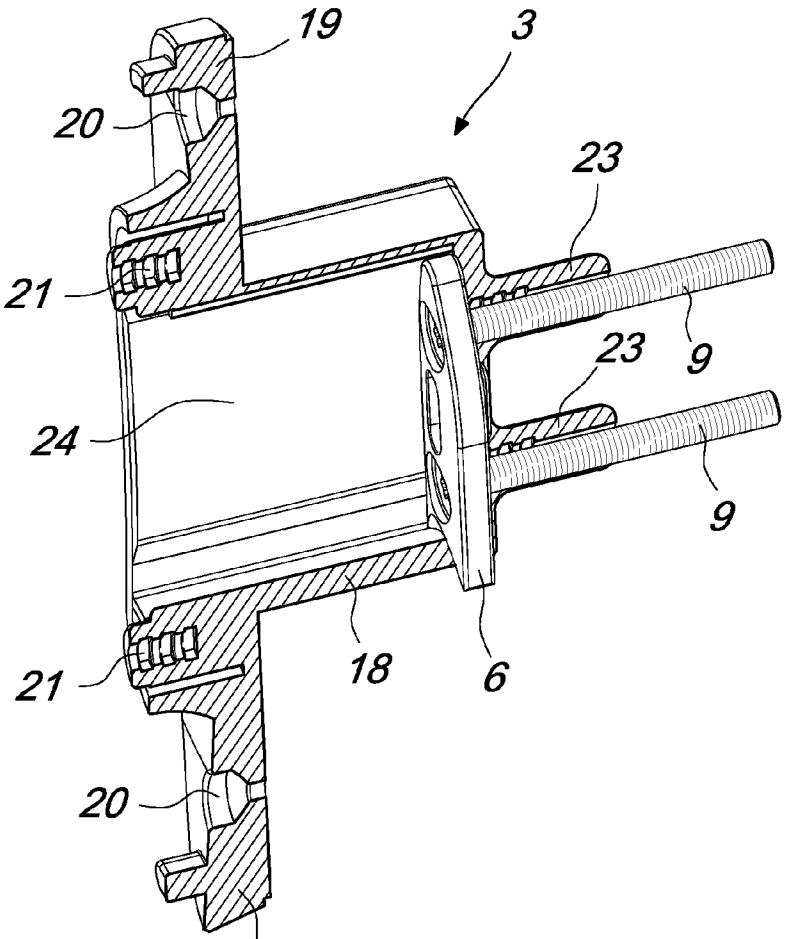
FIG. 9 is a view, similar to the preceding one, showing the rear support with the weight member fixed by the fastening screws.
Figure 8:
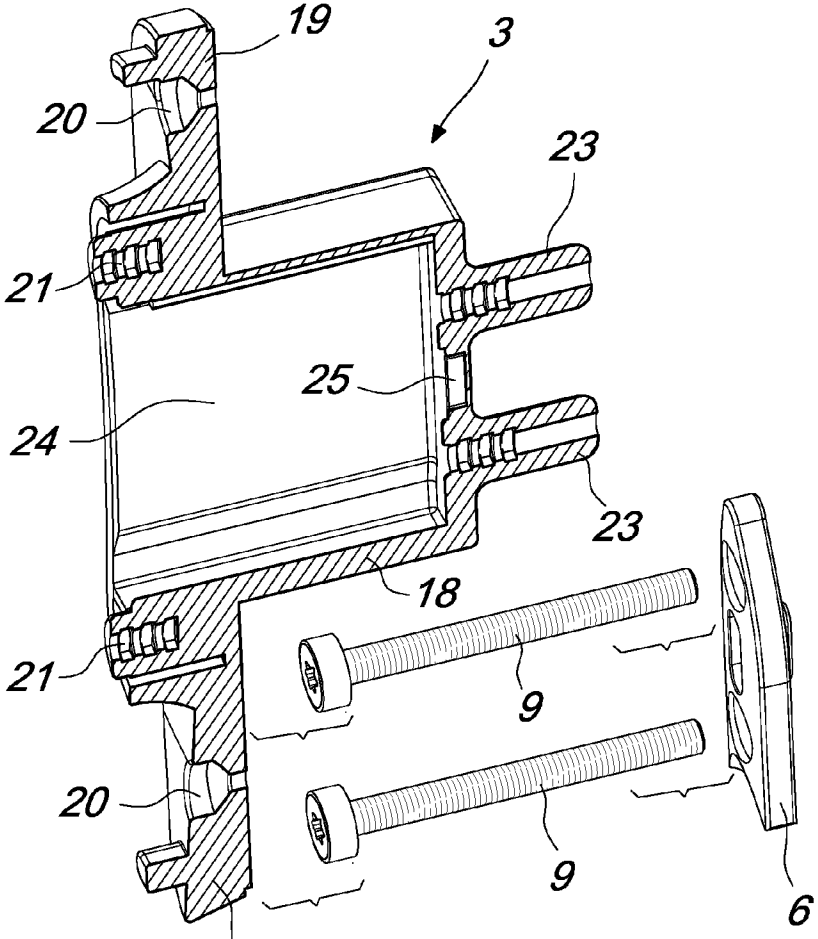
FIG. 8 is a longitudinally sectional exploded perspective view of the rear support of the device, of the two fastening screws and of a weight member.

With reference to the cited figures, the device according to the invention includes a front support 2 and a rear support 3, which are mounted respectively in the muzzle region 4 and in the stock 5 of a gun 1.

The front support 2 and the rear support 3 are configured to support one or more weight members 6.

Each weight member 6 is constituted by a flattened body provided with two holes 7 adapted to receive respective fastening screws 8 for the front support 2 and 9 for the rear support 3.

The weight member 6 includes a protrusion 10 which is formed on the rear side 11 of the flattened body, where rear is understood to reference the side of the flattened body that faces the support 2 when the weight member 6 is fastened thereto.

The protrusion 10 is adapted to engage a recess 12 that is formed on the front side 13 of an adjacent weight member 6, when multiple weight members are applied to the same support.

The protrusion 10 of the first weight member applied to the front support 2 is adapted to engage a seat that is formed in the front support 2 and is not visible in the figures.

The front support 2 is constituted by a shaped body 14 that is applied so as to be visible between the two barrels 15 and 16 of the rifle proximate to the muzzle 4.

The front support 2 includes a cover constituted by a rubber cap 17 which can be applied to the shaped body 14 in order to cover the seat of the protrusion 10 and the holes for the locking screws 8 when no weight members are applied to the front support 2.

The rubber cap 17 is applied in order to improve the aesthetics of the system when the weights are removed.

The shaped body 14 is arranged between the two barrels 15 and 16 of the gun 1 and is welded on both sides so as to have two faces, to the right and to the left of the barrels, to which it is possible to apply the weight members 6.

The figures show only the right side of the barrels; the left side of the front support is mirror-symmetrically identical to the right side.

The weight members 6 can be fastened on one or both sides of the front support and in a different number on one side with respect to the other, in order to modify the balance of the firearm.

The rear support 3 can accommodate the same weight members 6 used in the front support 2.

The weight members can be superimposed perfectly by virtue of their geometry, described above: the protrusion 10 and the corresponding recess 12.

The rear support 3 is inserted in the stock 5 of the gun 1 and includes a frame 18 provided with a flange 19 which has a means 20 for coupling to the body of the stock 5 and a fastening means 21 for fastening a butt plate 22.

The frame 18 has front guides 23 adapted to ensure both the correct placement of the component inside the stock 5 and the reduction of the stresses during firing on the component.

The frame 18 forms an internal housing 24 for the weight members 6, which are fastened by means of the two screws 9.

The housing 24 is shaped so as to accommodate a number of weight members 6, retained by the screws 9, the weight members 6 are thus firmly fastened when firing the gun.

The frame 18 has a seat 25 adapted to receive the protrusion 10 of the first weight member 6 inserted in the internal housing 24.

The balancing system according to the present invention allows a weight adjustment in a discrete manner by fastening one or more weight members 6 along the axis of the stock 5.

The system prevents any movement of the weight members also in the directions that are transverse to the barrel axis.

The operation of the balancing device according to the present invention is as follows.

The user can apply one or more weight members 6 on the front support 2, locking them by means of the screws 8.

If no weight member 6 is applied to the support 2, it is possible to apply the cover 17 to the shaped body 14 in order to cover the seat of the protrusion 10 and the holes for the fastening screws 8.

The application of the weight members 6 to the rear support 3 can be performed by removing the butt plate 22 and inserting one or more weight members 6 in the housing 24 and fastening them by means of the two screws 9.

The application and removal of the weight members 6 to and from the front and rear supports is simple and easy and can be repeated until the balance preferred by the user is achieved.

In practice it has been found that the invention achieves the intended aim and objects, providing a balancing device that allows to balance the firearm rapidly and easily.

The present invention thus allows to vary the balance of the firearm as the conditions of use thereof vary or according to the needs and preferences of the shooter.

According to the present invention it is possible to combine a small number of weight members, all mutually identical, in a different number in the front and rear supports in order to obtain the preferred balance of the firearm.

It should be noted that adding or removing weights from the front and rear supports is an extremely quick and easy operation, which allows the user to vary the balance with an ease that no prior art system could offer.

All the weight members 6 are mutually analogous, i.e., they have a common interface, constituted by the holes 7, the protrusion 10 and the recess 12, so that they can be combined with each other and can be applied equally to the front support 2 and rear support 3.

Advantageously, the weight members 6 can be all mutually identical in terms of material and thickness and balancing is adjusted by applying a different number of weight members 6 in the front support 2 and/or in the rear support 3, as described above.

The weight members 6 can also be mutually identical, in terms of shapes and dimensions, but made of different materials so that they have a different mass.

The weight members can be provided with similar longitudinal dimensions and be made of the same material but provided with a different thickness in order to give the user members having a different weight, which can in any case always be combined with each other by virtue of the analogous interface.

The device according to the invention is susceptible of numerous modifications and variations, all of which are within the scope of the inventive concept; all the details may furthermore be replaced with technically equivalent members.

The materials used, as well as the dimensions, may of course be any according to the requirements and the state of the art.

This application claims the priority of Italian Patent Application No. UA2016A007124 (corresponding to 102016000100452), filed on Oct. 6, 2016, the subject matter of which is incorporated herein by reference.

The invention claimed is:

1. A balancing assembly for a firearm, wherein the firearm includes at least one barrel having a muzzle and a stock, said balancing assembly comprising:

at least one front support and at least one rear support respectively mountable to said firearm in a region adjacent to said muzzle and in a region about said stock; and a plurality of weight members, said at least one front support and said at least one rear support each being configured to support one or more of said plurality of weight members, said one or more of said plurality of weight members being modular and mutually analogous, each one of said plurality of weight members including (i) a flattened body provided with at least one hole adapted to receive a locking screw to fasten the respective one of said plurality of weight members to said at least one front support or to said at least one rear support, (ii) at least one protrusion formed on one side of said flattened body, said protrusion being adapted to alternatively engage a seat formed in said at least one front support and a seat formed in said at least one rear support, and (iii) a recess formed on an opposite side of said flattened body, said at least one protrusion of any one of said plurality of weight members being insertable into said recess of any other one of said plurality of weight members when such weight members are attached to a same one of said at least one front support and said at least one rear support.

2. The assembly according to claim 1, wherein said at least one front support includes a shaped body attachable to said barrel proximate to the muzzle;

said at least one front support further including a cover attachable to said shaped body in order to cover said seat in said at least one front support and at least one threaded hole in said at least one front support for receiving said locking screw, said cover being attachable to said shaped body when none of said plurality of weight members are attached to said at least one front support.

3. The assembly according to claim 2, wherein said firearm comprises two superimposed barrels, said at least one barrel being one of said two superimposed barrels;

said shaped body being configured for arrangement between said two superimposed barrels and having two faces disposable on right and left sides of said two superimposed barrels;

each of said plurality of weight members being alternatively attachable to said faces.

4. The assembly according to claim 1, wherein said at least one rear support is inserted in said stock and comprises a frame provided with a flange;

said flange comprising a means for coupling to said stock and a fastening means for fastening a butt plate to the frame.

5. The assembly according to claim 4, wherein said frame comprises front guides adapted to ensure correct positioning of said at least one rear support inside said stock, reducing stresses on said at least one rear support during firing of the firearm.

6. The assembly according to claim 5, wherein said frame defines an inner housing configured to accommodate said plurality of weight members;

said plurality of weight members being fastened to said frame by said locking screw;

said housing being configured to receive a certain number of said plurality of weight members.

* * * * *